73-151
9/24/85 OR SR 4,542,647

United States Patent [19]
Molnar

[11] Patent Number: 4,542,647
[45] Date of Patent: Sep. 24, 1985

[54] BOREHOLE INERTIAL GUIDANCE SYSTEM

[75] Inventor: Daniel O. Molnar, Seattle, Wash.

[73] Assignee: Sundstrand Data Control, Inc., Redmond, Wash.

[21] Appl. No.: 617,355

[22] Filed: Jun. 5, 1984

Related U.S. Application Data

[63] Continuation-in-part of Ser. No. 468,725, Feb. 22, 1983, abandoned.

[51] Int. Cl.[4] ..... E21B 47/024
[52] U.S. Cl. ..... 73/151; 33/304; 175/45
[58] Field of Search ..... 73/151; 33/304, 312, 33/313; 175/45

[56] References Cited

U.S. PATENT DOCUMENTS

| | | | |
|---|---|---|---|
| 3,896,412 | 7/1975 | Rohr | 340/15.5 BA |
| 4,238,889 | 12/1980 | Barriac | 33/304 |
| 4,293,046 | 10/1981 | Van Steenwyk | 175/45 |
| 4,399,692 | 8/1983 | Hudsin, II et al. | 73/151 |
| 4,454,756 | 6/1984 | Sharp et al. | 73/151 |
| 4,457,168 | 7/1984 | Lautzenhiser et al. | 73/151 |

FOREIGN PATENT DOCUMENTS 2086055 5/1982 United Kingdom .

OTHER PUBLICATIONS

Watts, Alfred C., "The Application of Inertial Navigation to Wellbore Positional Surveying", Sandia Report Jun. 1982.
Wardlaw, Jr., Ralph, "The Wellbore Inertial Navigation System (WINS) Software Development and Test Results", Sandia Report Sep. 1982.
Kohler, Stewart M., "Inertial Navigation System for Directional Surveying", Sandia Report Sep. 1982.

*Primary Examiner*—Howard A. Birmiel
*Attorney, Agent, or Firm*—Christensen, O'Connor, Johnson & Kindness

[57] ABSTRACT

In order to improve the accuracy of borehole survey systems utilizing probes with inertial components including inclinometers, two ring laser gyro units are included to provide rotation information to the system. When the probe is moving in a borehole, inclinometer iformation is used to produce a synthetic rotation signal to take the piece of a third gyro and the earth's rotation is used for a similar purpose in combination with signals from the two ring laser gyros when the probe is stopped. Wire line velocity is used in combination with the inclinometer and gyro information to provide signals representing the probe velocity and position. Coordinate transformations are provided in the probe to transform the inertial signals and wire line velocity signals into earth reference coordinate system. Kalman filtering incorporates noninertial velocity data to reduce the effect of errors inherent in the generation of various input signals to the system.

30 Claims, 4 Drawing Figures

BOREHOLE INERTIAL GUIDANCE SYSTEM

CROSS-REFERENCE TO RELATED APPLICATIONS

This patent application is a continuation-in-part of U.S. patent application Ser. No. 468,725, filed Feb. 22, 1983, now abandoned.

TECHNICAL FIELD

This invention relates to the field of borehole survey instruments and, in particular, relates to borehole survey instruments utilizing acceleration and angular displacement sensors.

BACKGROUND OF THE INVENTION

In many prior art borehole survey systems, a probe is used that includes acceleration or inclinometer measuring instruments in combination with azimuth or direction determining instruments such as magnetometers. Examples of such systems are provided in U.S. Pat. Nos. 3,862,499 and 4,362,054 which disclose borehole surveying instruments using an inclinometer that includes three accelerometers to measure deviation of the borehole from vertical along with a three axis magnetometer for azimuth determination. Such systems are subject to errors due to a number of factors including variations in the earth's magnetic field caused by the nature of the material through which the borehole passes. There have also been a number of systems that have used gimballed or strapdown mechanical gyros in place of the magnetometers for direction or rotation sensing. However, due to sensitivity to shock and vibration, mechanical gyroscopes do not provide the desired accuracy and reliability for borehole systems. Further, mechanical gyros are subject to drift and precession errors and require substantial settling periods for stabilization. These instruments also tend to be mechanically complex, as well as expensive.

One approach for reducing the errors inherent in making inertial-type measurements of the probe location in a borehole has been the use of Kalman filtering. However, up to the present time, the use of Kalman filtering has been limited to alignment of the probe when stopped in the borehole and has not been used in a dynamic sense for error reduction in measurements made while the probe is moving within the borehole.

SUMMARY OF THE INVENTION

It is therefore an object of the invention to provide a borehole survey apparatus that includes a probe suitable for insertion in a borehole; a mechanism for generating a signal representing the movement of the probe in the borehole; and acceleration measurement instruments within the probe for generating three acceleration signals representing components of acceleration of the probe with respect to three probe axes and an angular rotation measuring means for generating two rotation signals representing the angular rotation of the probe with respect to two probe axes of rotation. Also included is a first circuit for generating a first synthetic angular rotation signal representing the angular rotation of the probe about a third probe axis when the probe is moving and a circuit responsive to the angular rotation signals for generating a second synthetic angular rotation signal representing the angular rotation of the probe about the third probe axis when the probe is not moving. The invention further includes a circuit responsive to the rotation signals and synthetic rotation signal for transforming the signals representing movement of the probe in the borehole into coordinates referenced to the earth and computation circuits connected to the transform circuit and the acceleration measuring circuits for converting the acceleration signals into a first set of velocity signals and a first set of position signals representing the velocity and position of the probe in the earth referenced coordinate system.

In accordance with the invention, a Kalman filtering is used both when the probe is stopped and when the probe is moving. In this regard, when the probe is moving, the Kalman filtering uses the dynamic constraints of zero motion normal to the borehole together with cable velocity to compensate for errors in acceleration, angular rotation, and alignment data used to generate the velocity and position signals. When the probe is held motionless for periodic alignment procedures, the Kalman filtering is reconfigured to level and find azimuth of the earth-reference coordinate system being used in the borehole surveying procedure accomplished by the invention.

DETAILED DESCRIPTION OF THE INVENTION

Figure 1:
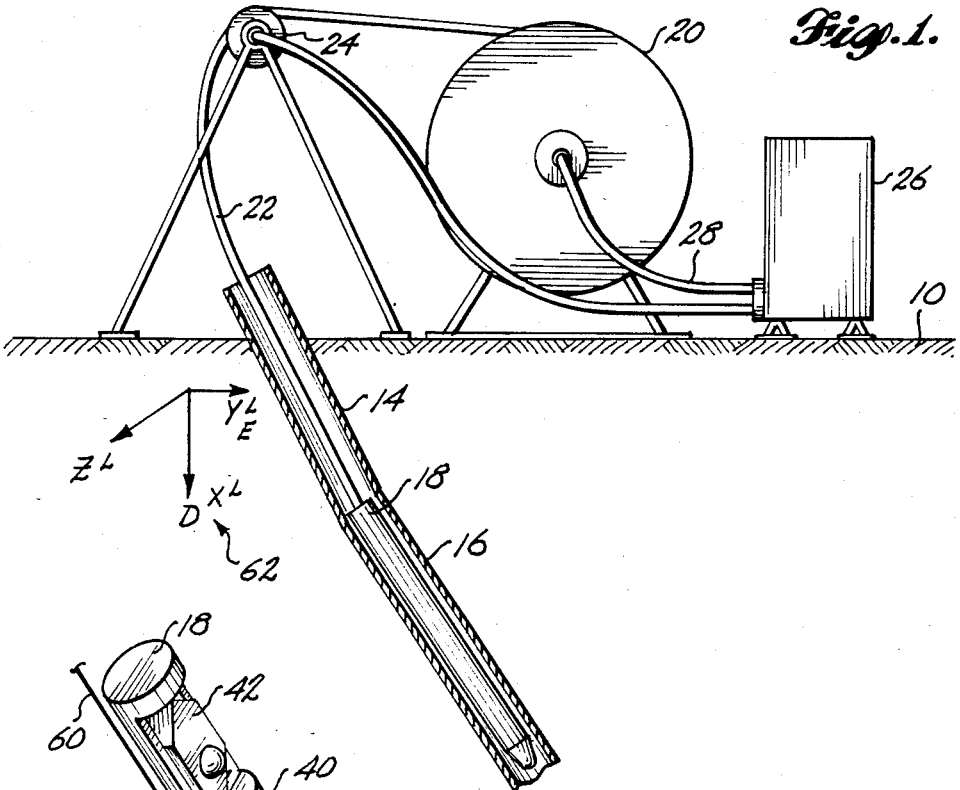
FIG. 1 is an illustration of an apparatus embodying the invention, including a section through a borehole showing a probe used with the borehole surveying apparatus.

In FIG. 1 is illustrated a representative environment for the preferred embodiment of the invention. Extending below the ground 10 is a borehole generally indicated at 12 that is lined with a plurality of borehole casings 14 and 16. Inserted into the borehole 12 is a probe 18 connected to a cable reel 20 by means of a cable 22 that runs over and above ground pulley 24. The cable 22 serves to lower the probe 18 through the borehole 12 and additionally provides a transmission medium for transmitting data from the probe 18 to a signal processor 26 above ground. Another signal transmission line 28 can be used to provide an indication of the amount of cable 22 that is paid out into the borehole 12 as well as data from cable 22 to the signal processor 26. Although in the invention illustrated in FIG. 1, data is transmitted to and from the probe 18 by means of the cable 22, data can be transmitted top-side by other known means such as pressure impulses transmitting digital data through drilling mud. If desired, the data can be stored in a memory in the probe 18 and retrieved at a later time.

Figure 1A:
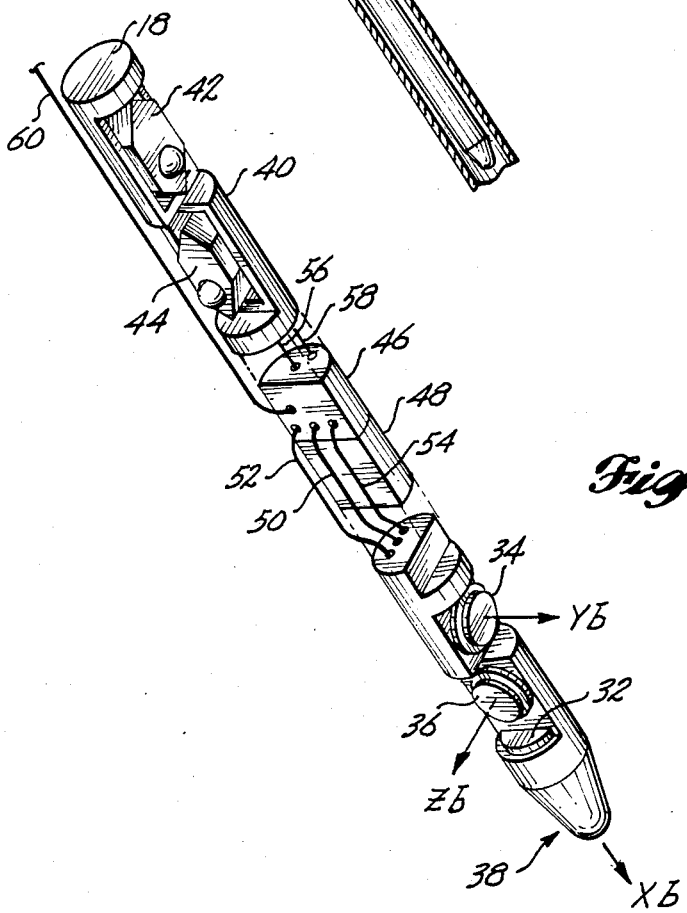

As shown in FIG. 1*a*, secured within the probe 18 is a triaxial accelerometer package including three accelerometers 32, 34 and 36. The accelerometers 32, 34 and 36 are orientated with their sensitive axes corresponding to the probe body as indicated by the coordinate system shown at 38. In the probe body coordinate system, the x axis as indicated by $x^b$ extends along the borehole and the y axis indicated by $y^b$ and the z axis as indicated by $z^b$ are orthogonal with respect to the $x^b$ axis.

Also included in the probe 18 is a laser gyro assembly 40 that includes two laser gyros 42 and 44. The first laser gyro 42 is orientated within the probe so as to measure the angular rotation of the probe around the $y^b$ axis wherein the angular rotation so measured is denoted by $\omega_y{}^b$. Similarly, the second laser gyro 44 is secured within the probe 18 such that it will measure probe rotation around the $z^b$ axis as denoted by $\omega_z{}^b$. Because the diameter of the probe 18 is relatively small, there is not sufficient room to provide a laser gyro that will effectively measure rotation around the $x^b$ axis.

Also included in the preferred embodiment of the probe 18 is a microprocessor 46 along with a memory 48. Connected to the microprocessor 46

Also included in the preferred embodiment of the probe 18 is a microprocessor 46 along with a memory 48. Connected to the microprocessor 46 from the accelerometers 32, 34 and 36 are lines 50, 52 and 54 that serve to transmit acceleration signals $a_x$, $a_y$ and $a_z$ representing acceleration of the probe along the $x^b$, $y^b$ and $z^b$ axes, respectively. In a similar manner, the microprocessor 46 is connected to the laser gyro assembly 40 by means of lines 56 and 58 that serve to transmit the angular rotation signal $\omega_y{}^b$ from the y axis gyro 42 and the angular rotation signal $\omega_z{}^b$ from the z axis gyro 44.

In the embodiment of the invention illustrated in FIG. 1*a*, a velocity signal $V^P$ is indicated as being transmitted by means of a line 60 to the microprocessor 46. As shown in FIG. 1, this signal commonly is generated by measuring the rate at which cable unwinds from pulley 24 as a determination of the velocity of the probe 18 in the borehole 12. There may be circumstances, however, when the $V^P$ signal could more profitably be generated in a different manner such as counting the pipe sections 14 and 16, downhole.

In determining the location of the probe and, hence, the location or a path of the borehole, which is, of course, the ultimate object of the invention, it is necessary to transform the various sensor signals which are generated in the body coordinate system 38 into a coordinate system that is referenced to the earth. Such a coordinate system is illustrated in FIG. 1 as shown generally at 62 wherein the x axis (indicated by the vector $x^L$) is parallel to the gravity vector $g^L$ and the remaining axes y and z are orthogonal to the $x^L$ axis and parellel with the ground. This coordinate system 62 is commonly referred to as the level coordinate system with the $z^L$ and $y^L$ axes representing directions such as North and East.

Figure 2:
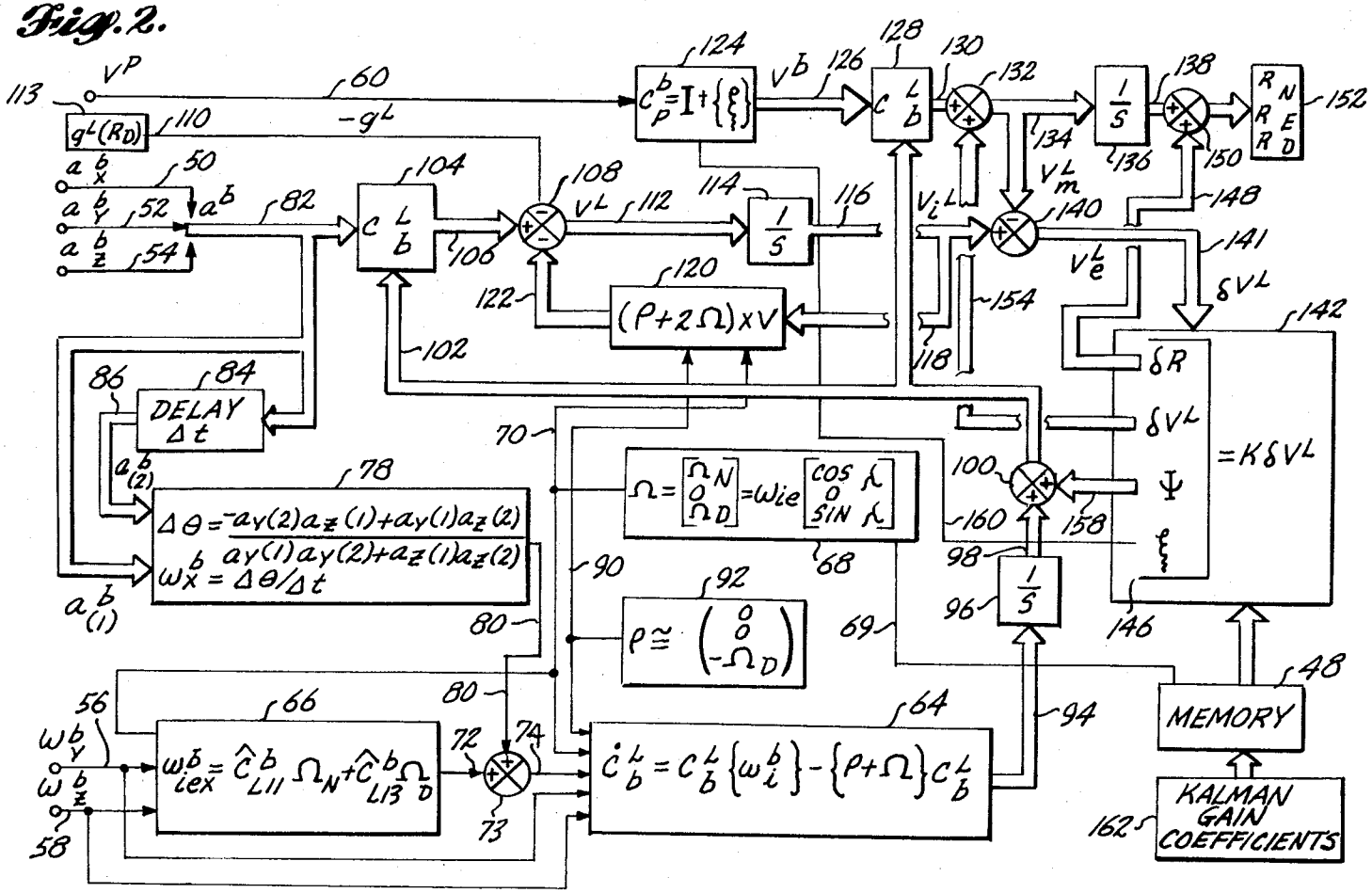
FIG. 2 is a logic diagram illustrating the logic for computing the location of the probe in the borehole.

The logic by which the microprocessor 46 converts the acceleration signals on lines 50, 52, and 54, the angular rate signals on lines 56 and 58 and the velocity signal on line 60 to location signals is illustrated in FIG. 2. It should be understood, however, that some of the processing could be accomplished in the computer 26 located top-side. As indicated before, one of the primary problems in generating signals representing the location of the probe 18 with respect to the earth coordinate system $x^L$, $y^L$ and $z^L$ is to accurately convert signals representing the orientation and movement of the probe 18 from the body coordinate system $x^b$, $y^b$ and $z^b$ into the level or earth coordinate system. One of the primary objects of the logic shown in FIG. 1 is to perform the coordinate transformation as accurately as possible utilizing Kalman filtering to compensate for the errors inherent in the various signal sources.

Definitions of the various symbols used in FIG. 2 are provided in TABLE I below.

TABLE I

| | | |
|---|---|---|
| $C_b{}^L$ | = | Probe body to level coordinate transformation matrix |
| $C_p{}^b$ | = | Pipe to probe body coordinate transform |
| $a_x{}^b$ | = | Acceleration along 'x' axis of body |
| $a_y{}^b$ | = | Acceleration along 'y' axis of body |
| $a_z{}^b$ | = | Acceleration along 'z' axis of body |
| $a_{(1)}{}^b$ | = | Acceleration vectors in probe body coordinates at a first time |
| $a_{(2)}{}^b$ | = | Acceleration vectors in probe body coordinates at a second time |
| $\omega_x{}^b$ | = | Angular rotation about 'x' axis of probe body |
| $\omega_y{}^b$ | = | Angular rotation about 'y' axis of probe body |
| $\omega_z{}^b$ | = | Angular rotation about 'z' axis of probe body |
| $V^P$ | = | Velocity of the probe along the pipe |
| $V_m{}^L$ | = | Velocity of the probe in level coordinates as measured |
| $V_i{}^L$ | = | Velocity of the probe in level coordinates derived inertially |
| $\Omega$ | = | Angular rotation of the earth |
| $\Omega_N$ | = | Angular rotation of the earth - North component |
| $\Omega_D$ | = | Angular rotation of the earth - Down component |
| $\rho$ | = | Angular velocity of the level coordinate system relative to the earth |
| $\omega_{ie}$ | = | = 15.04°/hr. |
| R | = | Position vector with following three components: |
| | $R_N$ = | North position coordinate |
| | $R_E$ = | East position coordinate |
| | $R_D$ = | Down position coordinate |
| $\lambda$ | = | Latitude |
| $\psi$ | = | Error in body to level transformation $C_b{}^L$, including two level components and one azimuth component |
| $\xi$ | = | Probe body misalignment in pipe |
| K | = | Suboptional Kalman gain coefficients |
| I | = | Identity matrix |
| $\tilde{R}$ | = | $R_e$ - depth of probe in borehole |
| $R_e$ | = | Radius of the earth |
| $g^L$ | = | Gravity vector $\begin{bmatrix} g_N{}^L \\ O_L \\ g_z \end{bmatrix}$ ; $g^L = g_o\left(\frac{R_e}{\tilde{R}}\right)^2 + 3\frac{\rho(R)}{\rho_{ave}}\tilde{R}$ |
| $\delta V^L$ | = | Velocity errors in level coordinates |
| $\epsilon_a$ | = | Accelerometer errors |
| $\epsilon_g$ | = | Gyro errors |
| $\mu_3$ | = | Gyro bias errors |
| $\nu$ | = | White measurement noise |
| $q_1$ | = | 'y' gyro white noise power spectral density in (degree/root hour)$^2$ |
| $q_2$ | = | 'z' gyro white noise power spectral density in (degree/root hour)$^2$ |
| $q_3$ | = | Uncertainty of twisting (roll $\omega_x{}^b$) of probe along the borehole while probe is in motion |
| $Q^L$ | = | Gyro random walk variance matrix in level coordinates |
| $X_e$ | = | Error states |
| $\dot{X}_e$ | = | Error dynamics between discrete measurements |
| $\phi$ | = | Time mapping for error equations |
| F | = | Dynamic error model matrix |
| H | = | Velocity measurement matrix |
| P | = | Covariance oferror states |
| $R_c$ | = | Covariance of white measurement raise |
| $W_s$ | = | $\sqrt{\frac{gR_e}{R_e}}$ Schuler oscillation rate (about 1/34 min.) |
| $\tau$ | = | Body-path misalignment time constant |
| {.} | = | Denotes the skew symmetric matrix representation of the enclosed vector. |

Logic for updating the coordinate transformation matrix $C_b{}^L$ is indicated within box 64 of FIG. 2. Inputs to this logic include the angular rotation signals $\omega_y{}^b$ and $\omega_z^b$ on lines 56 and 58. Since it is necessary to have a signal representing the rotation of the probe around the x axis $\omega_x^b$ to update the transformation logic in box 64, it is necessary to generate a synthetic $\omega_x^b$ signal. This is accomplished when the probe 18 is stopped in the borehole 12 by means of the logic enclosed within box 66, which operates on a signal, $\Omega$, that represents the rotation of the earth. The origin of the $\Omega$ signal is indicated in box 68 wherein, as shown, the signal $\Omega$ is composed of three vectors including $\Omega_N$ and $\Omega_D$ which represents the rotation of the earth about North and in a down direction respectively. Also as shown within box 68 the value of $\Omega$ is dependent upon the latitude $\lambda$ of the probe 18. To facilitate operation of logic of FIG. 2 in the probe microprocessor 46, the latitude $\lambda$ of the borehole can be stored in the memory 48 and transmitted to box 68 by means of line 69. The signal is then transmitted over line 70 to logic 66 which generates a first synthetic $\omega_{iex}^b$ signal on line 72. As is indicated in box 66, the first synthetic signal is of the form $\omega_{iex}^b = \hat{C}_{L11}^b \Omega_N + \hat{C}_{L13}^b \Omega_p$, where $\hat{C}_{L11}^b$ and $\hat{C}_{L13}^b$ are representative of the time averaged values (i.e., filtered or otherwise processed values) of the elements of the probe body to level transformation matrix ($C_b^L$) that are associated with the first row and the first and third columns of that matrix. Such time-averaging or filtering substantially reduces or eliminates minor fluctuations in the values of $C_L^b$ that occur as the coefficients (matrix elements) are updated through the hereinafter discussed operation of the logic indicated within box 66.

The accelerometer errors are calibrated while the probe is stopped and the acceleration due to gravity is reset to be equal and opposite to sensed acceleration.

When the probe is in motion through a borehole 12, a second synthetic $\omega_x^b$ signal is generated on line 80 by means of the logic shown in box 78. As shown in FIG. 2, the acceleration signals on line 50, 52 and 54 representing acceleration of the body $a^b$ (where $a^b = a_x^b + a_y^b + a_z^b$) are transmitted over a bus 82 to the logic 78 and a delay circuit 84. The first input into the logic 78 over a bus 82 may be termed $a_{(1)}^b$ which represents the body acceleration of the probe 18 at a first time relative to the y and z axis of the probe body coordinate system. The delay circuit 84 provides a second body acceleration signal $a_{(2)}^b$ over a bus 86 to the logic 78, with an acceptable time delay for the delay circuit 84 being 1/600th of a second. As is indicated by logic 78 of FIG. 2, the second synthetic signal $\omega_x^b$ is of the form $\omega_x^b = \Delta\theta/\Delta t$, where $\Delta t$ is the time delay of delay circuit 84, and where $\Delta\theta = (-a_{y(2)}\ a_{Z(1)} + a_{y(1)}\ a_{(2)})/(a_{y(1)}\ a_{y(2)} + a_{z(1)}\ a_{z(2)})$, which is equal to the cross-product of $a_{(1)}^b$ and $a_{(2)}^b$ divided by the "dot" or scalar product thereof. It will be noted by those skilled in the art that the value of both the numerator and denominator of the expression for $\Delta\theta$ approach zero as $a_x$ and $a_y$ approach zero (probe vertical). Although, under such conditions, the theoretical value of $w_x^b$ approaches a finite small value, system errors and noise will become appreciable. Thus, in some situations it may be advantageous to augment the arrangement of FIG. 2 with a switch or other such device (not shown in FIG. 2) that interrupts the signal provided by logic 78 when probe 18 is near vertical (e.g., when the probe 18 is within ½ or 1 degree of being vertical).

With continued reference to FIG. 2, the first and second synthetic signals ($w_x^b$ and $w_{iex}^b$) supplied by logic 78 and 66 (via lines 78 and 82) are combined within a summing junction 73 to form a synthetic signal of the form $w^b = w_x^b + w_{iex}$, which is coupled to logic 64 by means of line 74). Also coupled to logic 64 is the $\Omega$ signal on line 70 and a signal on line 90 which represents the angular velocity of the probe relative to the earth as indicated by box 92. The output of logic 64 $C_b^L$ that is supplied to bus 94 represents the time rate of change of the probe body to level coordinate transform resulting from the acceleration signals $a^b$ and the angular rotation signals $\omega^b$. This signal is then integrated as indicated at 96 thereby producing on bus 98 a signal $C_b^L$ that represents the transformation matrix required to convert signals generated in the body coordinate system 38 into the level coordinate system 62. The signals on line 98 representing the coordinate transform matrix $C_b^L$ is corrected at the summing junction 100 and then transmitted to a bus 102 and are utilized by logic 64 and 104 during the next iteration of the signal processing sequence represented by FIG. 2.

The accelerations $a^b(a_x^b, a_y^b, a_z^b)$ are converted from body coordinates to level coordinates by means of logic 104 which receives the updated coordinate transformation matrix $C_b^L$ over bus 102. The resulting output on bus 106 represents the acceleration of the probe 18 in level coordinates and is transmitted to a summing junction 108. Subtracted in the summing junction 108 is a signal $g^L$ on line 110 that represents acceleration due to gravity resulting in a signal on a bus 112 representing the acceleration $\dot{v}_i^L$ of the probe 18 in level coordinates. As indicated by box 113, $g^L$ is a function of the depth $R_d$ of the probe 18. This signal is then integrated as indicated at 114 to produce a signal on bus 116 representing the velocity $v_i^L$ of the probe 18 in level coordinates.

The resulting velocity signal $V_i^L$ is fed back by means of a bus 118 to logic 120 that, in turn, generates signals on bus 122 representing corrections for Coriolis force. The resulting signal on bus 122 is, in turn, subtracted from the acceleration signals $a^L$ in summing junction 108. As a result, it may be appreciated that the resulting signal on bus 112 represents the acceleration, $\dot{V}_i^L$, of the probe 18 in the borehole taking into account gravity and acceleration generated by the earth's rotation.

In addition to the velocity signals generated by the inertial means as described above, velocity signals are also produced by actually measuring the movement of the probe 18 in the borehole. As previously described, the signal $V^P$ on line 60 can represent the wire line speed of the probe in the borehole or can be provided by other known means. This signal is transformed by means of logic shown in box 124 into a velocity signal on a bus 126 representing the velocity of the probe in body coordinates $V^b$. As indicated in box 124, the transform matrix $C_P^b$ is formed by combining an identity matrix I with a matrix $\xi$ through the process of matrix addition, where $\xi$ represents the misalignment of the probe 18 in the borehole casings 14 and 16. The resulting velocity signal $V^b$ on bus 126 is then transformed by means of the coordinate transform matrix $C_b^L$ shown at 128 to provide velocity signals $V_m^L$ in the level coordinate system on bus 130. These velocity signals are then transmitted through a summing junction 132 to provide a bus 134 with a measured velocity signal $V_m^L$. The signal $V_m^L$ is integrated as shown at 136 to generate on bus 138 signals representing the position coordinates R of the probe with respect to North, East and down as expressed in the level coordinate 62.

As may be expected, the velocity signals on bus 134 resulting from actual wire line measurements and the velocity signals on bus 116 resulting from inertial signal sources are subject to sundry sources of errors. In order to provide a signal $\delta V^L$ representing the relative error between velocity signal on busses 116 and 124, the signals on busses 116 and 134 are applied to a summing junction 140 resulting in the velocity error signal $\delta V^L$ in level coordinates on bus 141. To compensate for the various sources of errors that are present in the generation of the velocity signals and, hence, position signals, Kalman filtering is used to estimate the error correction signals.

One of the principal objects of using a reduced order Kalman filter is to compensate for the missing or degraded inertial data. This technique makes use of the fact that over significant distance in the borehole, the probe 18 is constrained to follow the borehole axis which can be translated into equivalent velocity information thereby enhancing the borehole survey accuracy. The use of dynamic constraints of this nature provides a significant advantage over the systems disclosed in the prior art. Computational burden in the Kalman filtering operation is reduced by modeling only the most significant error states.

The Kalman filter process is indicated by a logic block 142 which receives as input the velocity error signal $\delta V^L$ over bus 141. As indicated in the logic block 142, the Kalman gain coefficients K are multiplied by the velocity error signal $\delta V^L$ to define current or updated values of $\delta R$, $\delta V^L$, $\psi$ and $\xi$. The current or updated values of these error signals are then supplied to various portions of the logic shown in FIG. 2 in order to provide for error compensation. For example, error compensation terms, $\delta R$, for the position coordinates R are applied by means of a bus 148 to a summing junction 150 to provide updated position coordinates as shown at 152. Similarly, velocity error terms, $\delta V^L$, are applied over bus 154 the summing junction 132 in order to provide error compensation for the measured and inertially determined velocity singals $V_m^L$ and $V_i^L$. The three components of the error term $\psi$ for the body to level transform matrix $C_b^L$ are provided on bus 158 to the summing junction 100 and error terms are applied over line 160 to correct for misalignment $\psi$ in the transformation logic 124.

In order to enhance the efficiency of the process, the Kalman coefficients K may be stored in memory 48 within the probe rather than computed downhole, as indicated by box 162. By placing the Kalman coefficients K in memory 48, the transformation processes can be dynamically corrected within the probe 118 while it is in the borehole 12.

In a linear discrete Kalman filter, calculations at the covariance level ultimately provide the Kalman gain coefficients K, which are then used in the calculation of expected values of the error states $X_e$. These error states include eleven basic elements expressed by:

$$X_e \triangleq \begin{bmatrix} \delta R \\ \delta V \\ \psi \\ \xi \end{bmatrix} \quad \text{Eq(1)}$$

In the system model, the error states are a function of $\Phi$, that is the time mapping for error equations. The term $\Phi$ is equal to:

$$\Phi \simeq I + F\,\Delta t \quad \text{Eq(2)}$$

where F matrix represents the error dynamics between discrete measurements:

$$\begin{bmatrix} \dot{R} \\ \dot{V} \\ \dot{\psi} \\ \dot{\xi} \end{bmatrix} = F \begin{bmatrix} R \\ V \\ \psi \\ \xi \end{bmatrix} + \text{noise} \quad \text{Eq(3)}$$

Equation (3) is detailed as follows:

$$\delta\dot{R} = \{V^L\}\psi + C_b^L\{V^b\}\xi + C_b^L\nu^b \quad \text{Eq(4)}$$

$$\delta V = \begin{bmatrix} -\omega_s^2 & 0 & 0 \\ 0 & -\omega_s^2 & 0 \\ 0 & 0 & 2\omega_s^2 \end{bmatrix} \delta R - \{2\Omega\}\delta V - \{A\}\psi + C_b^L\epsilon_a \quad \text{Eq(5)}$$

$$\dot{\psi} = -\Omega\psi + C_b^L\epsilon_g \quad \text{Eq(6)}$$

$$\xi = -\frac{1}{\tau}\epsilon + \omega \quad \text{Eq(7)}$$

The measurement model can be expressed as:

$$y^b = HX_e + \nu \quad \text{Eq(8)}$$

where H represents the velocity measurement matrix:

$$y^b = C_L^b\delta V - C_L^b\{\nu^L\}\psi + \{\nu^b\}\xi - \nu^b$$

The Kalman gain coefficients K can be represented by:

$$K = P(-)H^T[HP(-)H^T + R]^{-1} \quad \text{Eq(10)}$$

where the error covariance update is:

$$P(+) = [I - K\,H]P(-) \quad \text{Eq(11)}$$

The gyro process noise covariance matrix is defined as:

$$Q^L = C_b^L \begin{matrix} q_1 & 0 & 0 \\ 0 & q_2 & 0 \\ 0 & 0 & q_3 \end{matrix} C_L^b \quad \text{Eq(12)}$$

The variance $q_3$ and gyro bias $\mu_3$ based on the nonlinear reconstruction of the missing $\omega_x$ gyro are given below as:

$$q_3 = 3.6\,q \qquad \mu_3 = -4.5\,q \quad \text{Eq(13)}$$

where $q = q_1 = q_2$, is the gyro random walk variance. During motion $q_3$ becomes the variance associated with the logic of block 78.

As may be seen from the above discussion, the constraints inherent in a borehole survey system where the probe 18 has substantially zero motion perpendicular to the pipe casing 14 and 16 of FIG. 1 are used to facilitate error estimation and correction. For example, an error signal is generated to correct probe roll attitude by differencing the expected acceleration signals on the body y and z axes with the sensed accelerations $a_y$ and $a_z$ on lines 52 and 54. Additionally, as the error signals are processed over time the estimate of body to path misalignment improves.

The stored gravity Model 113 can be reset in order to cancel the sensed acceleration $a_x$, $a_y$ and $a_z$ using the following relation:

$$g^L = g_o\left(\frac{\tilde{R}_e}{\tilde{R}}\right)^2 + 3\frac{\rho(\tilde{R})}{\rho_{avr}}\tilde{R} \qquad \text{Eq(14)}$$

where $\rho(R)$ represents density.

The techniques described above can be used in a number of different borehole applications. For example, in a measure while drilling environment the described survey method can be used for drill guidance without the necessity of transmitting data to the surface. In this case, the attitude of the probe 18 is determined using the logic illustrated at 66 to provide leveling, azimuth and tool face information.

Well surveying, on the other hand, can make use of the attitude data developed while the probe 18 is moving as provided by the logic in block 78 along with the attitude data generated when the probe is stopped as provided by the logic in block 66.

As is known to those skilled in the art, inertial guidance of the type utilized in the practice of this invention can be aided or enhanced by periodically stopping the probe 18. With probe 18 stopped, the velocity that is indicated or calculated by the system provides an error signal that can be processed by means of Kalman filtering to provide an estimate of the true state of the system and the various system error parameters. In the practice of this invention, such periodic aiding or enhancement is accomplished by reconfiguring the previously discussed Kalman filtering process while the probe 18 is held motionless within the borehole to thereby facilitate north finding.

Figure 3:
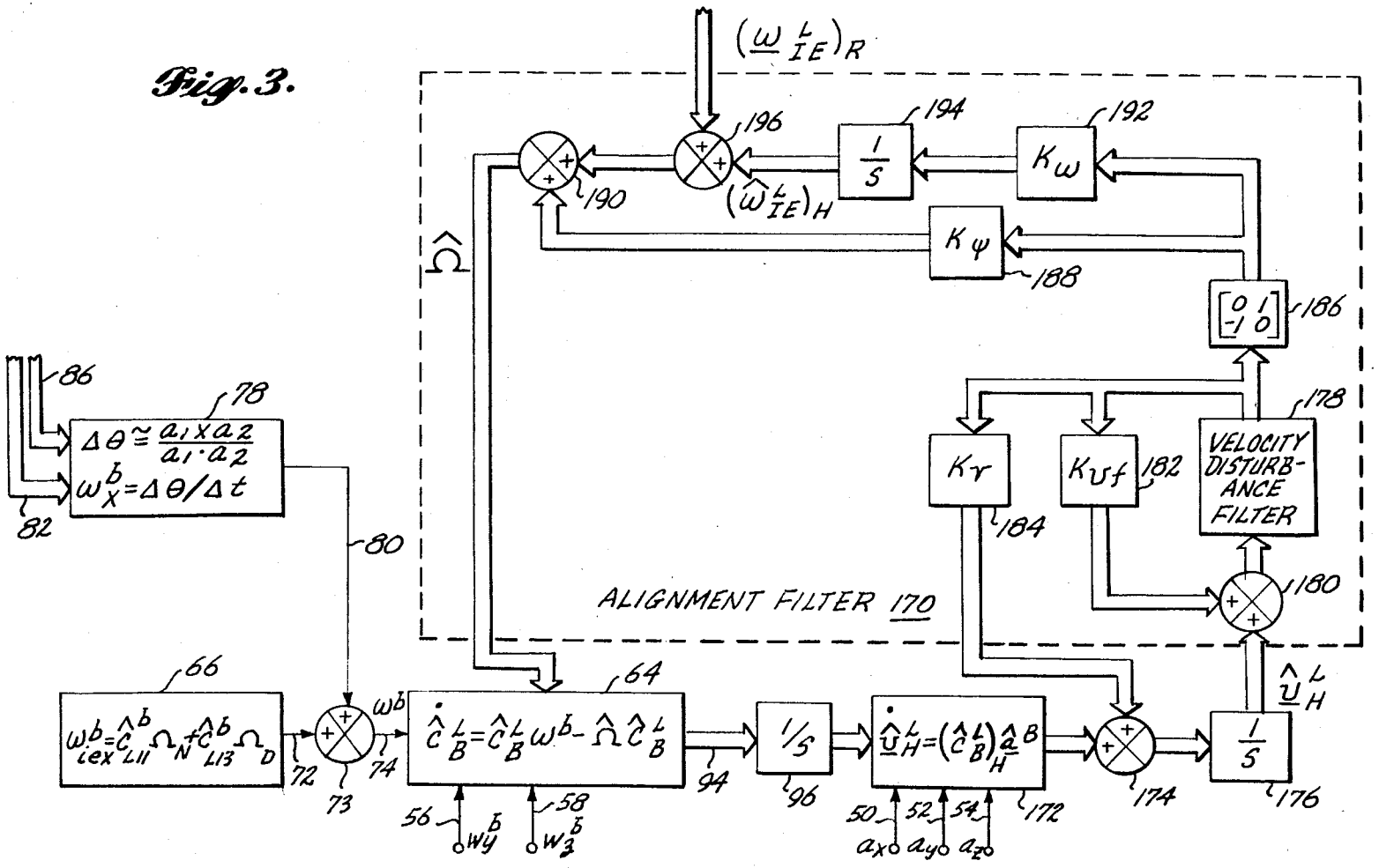
FIG. 3 is a logic diagram illustrating the logic utilized for an alignment procedure that is preformed while the probe is periodically stopped within the the borehole.

More specifically, and with reference to FIG. 3, when the probe 18 is stopped for downhole alignment or wander angle mechanism, logic 66 and 78 operate in the manner discussed relative to FIG. 2 to provide first and second synthetic signals ($\omega_{iex}{}^b$ and $\omega_x{}^b$). The first and second synthetic signals, which are combined by summing junction 73 are supplied to logic 64 along with a signal $\Omega$, which is supplied by the hereinafter discussed alignment filter 170. Logic 64 of FIG. 3 processes the applied signals in the manner discussed relative to FIG. 2 to provide a signal $C_b{}^L$, which is representative of the time rate of change in the estimate of the probe body to level coordinate transform matrix. Since the probe 18 is motionless, corect alignment is attained when the hereinafter discussed signal processing produces a signal $\Omega$ that causes the output of logic 64 to become substantially zero.

As is shown in FIG. 3, the signal provided by logic 64 is integrated at block 96 to provide updated values of the transformation estimates $\hat{C}_B{}^L$. These updated values are used by logic 64 during the next iteration of the alignment process and the two rows thereof that are associated with the horizontal axes of level coordinate system 62 are supplied to logic 172 of FIG. 3. Logic 172 functions in a manner similar to logic 104 of FIG. 2 to transform the acceleration signals $a_x{}^b$, $a_y{}^b$ and $a_z{}^b$ (which are supplied over lines 50, 52 and 54 and are collectively denoted by the symbol $\hat{a}^B$ in FIG. 3) into a signal that represents the horizontal components of the acceleration of probe 18 in the level coordinate system. The signal $\hat{v}_H{}^L$ that is supplied by logic 172 is coupled to an integrator 176 by means of a summing junction 174, which combines $\hat{v}_H{}^L$ with a feedback signal provided by alignment filter 170. The signal $v_H{}^L$ which is provided by integrator 176 and which represents an estimate of the horizontal components of the velocity of probe 18 (based on the output signals provided by accelerometers 32, 34 and 36) additionally is coupled to a velocity disturbance filter 178 by means of a summing junction 180. The transfer function of velocity disturbance filter 178 is established in accordance with the characteristics of each particular embodiment of the invention so as to eliminate abrupt signal transitions in the signal supplied by integrator 176.

With continued reference of FIG. 3, the signal provided by velocity disturbance filter 178 is coupled to summing junctions 174 and 180 via feedback paths that exhibit gain constants represented by $K_v$ and $K_{vf}$ (at blocks 184 and 182 in FIG. 3). As will be understood by those skilled in the art, the gain constants $K_v$ and $K_{vf}$ contribute to the signal processing effected by velocity distribution filter 178. In addition to supplying feedback, the signal provided by velocity disturbance filter 178 is transformed by the matrix indicated at block 186 to simplify subsequent signal processing. In this regard, the transformation effected by block 186 allows the required $\Omega$ signal to be supplied to logic 64 by means of two signal paths rather than four signal paths. As is shown in FIG. 3, in the first signal path, signals supplied by block 186 are multiplied by a set of scaler gain factors $K_\psi$ (at block 188) and supplied to one input of a summing junction 190. In the second signal path, the signals provided by block 186 are multiplied by a set of gain factors $K_\omega$ (at block 192); integrated at block 194; and supplied to the second input of summing junction 190 via summing junction 196. Summing junction 196 combines the signal $(\hat{\omega}_{IE}{}^L)_H$, which is provided by integrator 194, with a signal $(\omega_{IE}L)_R$, which is representative of the vertical component of the rotational rate of the earth and is equal to $\Omega \sin \lambda$, where $\lambda$ is the latitude of the borehole and, thus, probe 18.

In each periodic downhole alignment procedure, integrator 96 is initialized so that logic 64 utilizes a probe body to level coordinate transform matrix $\hat{C}_B{}^L$ that corresponds to the probe body to level coordinate transform matrix that is obtained when the probe 18 was aligned during the next-most antecedent alignment procedure. In this regard, as is known to those skilled in the art, the first step of utilizing a borehole survey system the includes accelerometers and gyroscopes is to hold the probe motionless at the surface of the earth to allow the system to determine an initial attitude reference from the gyroscope signals (the direction of North, which is ordinate $z^L$ in level coordinate system 62 of FIG. 1) and to determine verticallity (i.e., the $x^L$ and $y^L$ axes of the level coordinate system 62 in FIG. 1) from the signal supplied by the accelerometers. In the present invention, the initial or top-side calibration procedure differs from the prior art in that the angular rotation signal for the axis $x^b$, which extends longitudinally along the probe body 18, is synthesized in the previously described manner, rather than being generated by a gyroscope. This difference between the source of angular rotation signals does not alter the basic alignment procedure. Thus, during the first downhole alignment interval, the probe body to level transform matrix obtained during the above-ground alignment is used as an initial estimate of $\hat{C}_B{}^L$; during the next alignment procedure the first below ground valves of $\hat{C}_B{}^L$ are used as initial estimates; etc.

In addition to initializing integrator 96 in the above-described manner during each downhole alignment procedure, integrator 176 is initialized at zero. The signal processing indicated in FIG. 3 and discussed above, is then performed for a number of iterations (time period) that permits the discussed Kalman filtering to process the acceleration signals provided by the accelerometers 32, 34 and 36 of FIG. 1, the angular rotation signals provided by laser gyros 42 and 44 of FIG. 1 and the synthetic rotational signal supplied by logic 66 and 78 so as to produce a minimum error estimate of the probe body to level coordinate transformation matrix $C_B{}^L$. As described above, this process aids the borehole survey system of this invention by re-establishing the level coordinate system to prevent errors that can otherwise result during prolonged uninterrupted borehole navigation or survey.

What is claimed is:

1. A borehole survey apparatus comprising:

a borehole probe for insertion in a borehole;

control means for controlling the movement of said probe in the borehole;

means for generating a signal representative of the angular rotation of the earth;

acceleration means secured within said probe for generating three acceleration signals representing the components of acceleration of said probe with respect to three axes;

first angular means secured within said probe for generating two rotation signals representing the angular rotation of said probe with respect to two axes of rotation;

means responsive to said acceleration signals for generating when said probe is moving a first synthetic angular rotation signal representing the angular rotation of said probe about a third axis of rotation different from said two axes of rotation;

means responsive to said signal representative of the angular rotation of the earth for generating when said probe is not moving a second synthetic angular rotation signal representing the angular rotation of said probe about said third axis of rotation;

transform means responsive to said rotation signals and at least one of said first and second synthetic rotation signals, said transform means including means for providing a transformation signal for transforming signals representing probe movement in a probe referenced coordinate system to an earth referenced coordinate system; and first computation means operatively connected to said transform means and acceleration means for converting said acceleration signals into a first set of velocity signals representing the velocity of said probe.

2. The apparatus of claim 1, further comprising:

means operatively connected to said control means and said probe for generating a signal representative of the movement of said probe; and second computation means operatively connected to said transform means for converting said movement signal into a second set of velocity signals representing the velocity of said probe and a set of position signals representing the position of the probe in said earth reference coordinate system.

3. The system of claim 2, further comprising means operably connected to said first and second computation means for comparing said first set of velocity signals with said second set of velocity signals and generating an error signal.

4. The system of claim 3, further comprising Kalman filter means operatively connected to said transform means and said means for comparing said first set of velocity signals with said second set of velocity signals for correcting said velocity signals.

5. The apparatus of claim 4, wherein said probe includes memory means for storing Kalman gain coefficients for said Kalman filter means.

6. The apparatus of claim 4, wherein said probe includes means of calculating Kalman gain coefficients for said Kalman filter means.

7. The apparatus of claim 1 wherein said transformation signal is equivalent to a probe body to level coordinate transformation matrix and wherein said means for generating said second synthetic signal includes means for combining said signal representing the angular rotation of the earth with said transformation signal.

8. The apparatus of claim 7 wherein said means for combining said signals representing said rotation of the earth with said transformation signal means is configured and arranged to combine said signals in accordance with the expression $\omega_{iex}{}^b = \hat{C}_{L11}{}^b\,\Omega_N + \hat{C}_{L13}{}^b\,\Omega_D$, where $\omega_{iex}{}^b$ represents said second synthetic signal, $\hat{C}_{L11}{}^b$ and $\hat{C}_{L13}{}^b$ represent elements in the first row and the first and third column of said probe body to level cooridinate transformation matrix and $\Omega_N$ and $\Omega_D$ represent components of said signal representing the angular rotation of the earth relative to two axes of said earth referenced coordinate system.

9. The apparatus of claim 1 wherein said transform means includes means for combining said signal representing the angular rotation of the earth with a signal representative of said first and second synthetic rotation signals and with said rotation signals to repeatedly update said transform signal.

10. The apparatus of claim 9 further comprising means for summing said first and second synthetic rotation signals to form said signal representative of said first and second signal.

11. The apparatus of claim 10, further comprising:

means operatively connected to said control means and said probe for generating a signal representative of the movement of said probe; and second computation means operatively connected to said transform means for converting said movement signal into a second set of velocity signals representing the velocity of said probe and a second set of position signals representing the position of the probe in said earth referenced coordinate system.

12. The system of claim 11, further comprising means operably connected to said first and second computation means for comparing said first set of velocity signals with said second set of velocity signals and generating an error signal.

13. The system of claim 12, further comprising Kalman filter means operatively connected to said transform means and said means for comparing said first set of velocity signals with said second set of velocity signals for correcting said velocity signals.

14. The apparatus of claim 13, wherein said probe includes memory means for storing Kalman gain coefficients for said Kalman filter means.

15. The apparatus of claim 13, wherein said probe includes means of calculating Kalman gain coefficients for said Kalman filter means.

16. The apparatus of claim 1 further comprising means for supplying signals representative of the angular velocity of said probe relative to the earth and means for supplying said signals to said transform means, said transform means including means for combining said signals representative of the angular velocity of said probe relative to the earth with a signal representative of said first and second synthetic signals and with said rotation signals to supply said transform signal.

17. The apparatus of claim 16 wherein said transform means includes means for combining said signals representing the angular rotation of the earth with said signal representing said first and second synthetic rotation signals, said rotation signals and said signals representative of the angular velocity of said probe relative to the earth to provide said transform signal.

18. The apparatus of claim 17 wherein said transform means includes signal integrating means and said transform signal is substantially equivalent to the integral of $C_b^L\{\omega_i^b\}-\{\rho+\Omega\}C_b^L$, where $C_b^L$ is a probe body to earth coordinate transformation matrix, $\omega_i^b$ is a matrix representing the angular rotation of the probe body about said first second and third axis of rotation, $\rho$ is a matrix representing the angular velocity of the coordinate system consisting of said first second and third axis of rotation relative to said earth referenced coordinate system, and $\Omega$ is a matrix representing the angular rotation of the earth in said earth referenced system.

19. The apparatus of claim 18 further comprising means for summing said first and second synthetic rotation signals to form said signal representive of said first and second signal.

20. The apparatus of claim 19, further comprising:

means operatively connected to said control means and said probe for generating a signal representative of the movement of said probe; and second computation means operatively connected to said transform means for converting said movement signal into a second set of velocity signals representing the velocity of said probe and a second set of position signals representing the position of the probe in said earth referenced coordinate system.

21. The system of claim 20, further comprising means operably connected to said first and second computation means for comparing said first set of velocity signals with said second set of velocity signals and generating an error signal.

22. The system of claim 21, further comprising Kalman filter means operatively connected to said transform means and said means for comparing said first set of velocity signals with said second set of velocity signals for correcting said velocity signals.

23. The apparatus of claim 22, wherein said probe includes memory means for storing Kalman gain coefficients for said Kalman filter means.

24. The apparatus of claim 22, wherein said probe includes means of calculating Kalman gain coefficients for said Kalman filter means.

25. The apparatus of claim 1 further comprising:

time delay means responsive to first and second ones of said three acceleration signals that are associated with axes corresponding to said two axes represented by said two rotation signals, said time delay means for delaying each applied acceleration signal; and means for supplying time delayed acceleration signals supplied by said time delay means to said means for generating said first synthetic angular rotation signal;

said means for supplying said first synthetic angular rotation signal including means for supplying a signal representative of $\Delta\theta_x^b=(-a_{y(2)}a_{z(1)}+a_{y(1)}a_{z(2)})/(a_{y(2)}a_{y(2)}+a_{z(1)}a_{z(2)})$, where $a_{y(1)}$, $a_{z(1)}$ represent said two acceleration signals and $a_{y(2)}$ and $a_{z(2)}$ represent time delayed representations of said two acceleration signals;

said means for generating said first synthetic angular rotation signal further including means for supplying a signal representative of $\Delta\theta_x^b/\Delta t$ as said first synthetic angular rotation signal, where $\Delta t$ denotes the time delay effected by said time delay means.

26. The apparatus of claim 25 wherein said transformation signal is equivalent to a probe body to level coordinate transformation matrix and wherein said means for generating said second synthetic signal includes means for combining said signal representing the angular rotation of the earth with said transformation signal.

27. The apparatus of claim 26 wherein said means for combining said signals representing said rotation of the earth with said transformation signal means is configured and arranged to combine said signals in accordance with the expression $\omega_{iex}^b=\hat{C}_{L11}^b\,\Omega_N+\hat{C}_{L13}^b\,\Omega_D$, where $\omega_{iex}^b$ represents said second synthetic signal, $\hat{C}_{L11}^b$ and $\hat{C}_{L13}^b$ represent elements in the first row and the first and third column of said probe body to level coordinate transformation matrix and $\Omega_N$ and $\Omega_D$ represent components of said signal representing the angular rotation of the earth relative to two axes of said earth referenced coordinate system.

28. The apparatus of claim 27 further comprising means for supplying signals representative of the angular velocity of said probe relative to the earth and means for supplying said signals to said transform means, said transform means including means for combining said signals representative of the angular velocity of said probe relative to the earth with a signal representative of said first and second synthetic signals and with said rotation signals to supply said signal for transforming probe movement in said probe referenced coordinate system to probe movement in said earth referenced coordinate system.

29. The apparatus of claim 28 wherein said transform means includes means for combining said signals representing the angular rotation of the earth with said signal representing said first and second synthetic rotation signals, said rotation signals and said signals representative of the angular velocity of said probe relative to the earth to provide said transform signal.

30. The apparatus of claim 29 wherein said transform means includes signal integrating means and said transform signal is substantially equivalent to the integral of $C_b^L\{\omega_i^b\}-\{\rho+\Omega\}C_b^L$, where $C_b^L$ is a probe body to earth coordinate transformation matrix, $w_i^b$ is a matrix representing the angular rotation of the probe body about said first second and third axis of rotation, $\rho$ is a matrix representing the angular velocity of the coordinate system consisting of said first second and third axis of rotation relative to said earth referenced coordinate system, and $\Omega$ is a matrix representing the angular rotation of the earth in said earth referenced system.

* * * * *

UNITED STATES PATENT AND TRADEMARK OFFICE

CERTIFICATE OF CORRECTION

PATENT NO. : 4,542,647

DATED : September 24, 1985

INVENTOR(S) : Molnar

It is certified that error appears in the above—identified patent and that said Letters Patent is hereby corrected as shown below:

| | | |
|---|---|---|
| Abstract, | line 6: | "iformation" should be --information-- |
| Abstract, | line 7: | "piece" should be --place-- |
| Abstract, | line 15: | "reference" should be --referenced-- |
| Column 2, | line 10: | "filtering" should be --filter-- |
| | line 13: | "filtering" should be --filter-- |
| | line 19: | "filtering" should be --filter-- |
| | line 34: | "preformed" should be --performed-- |
| | line 35: | delete "the" (second occurrence) |
| Column 3, | lines 14-16: | delete "Also included . . . the microprocessor 46" (entire paragraph) |
| | line 48: | "parellel" should be --parallel-- |
| Column 4, | line 22: | delete "=" (second occurrence) |
| | line 35: | "$O_L$" should be --O--; and, |
| | | "$g^L$" should be --$g_z^L$ |
| | Line 56: | "oferror" should be --of error-- |

UNITED STATES PATENT AND TRADEMARK OFFICE

CERTIFICATE OF CORRECTION

PATENT NO. : 4,542,647

DATED : September 24, 1985

INVENTOR(S) : Molnar

It is certified that error appears in the above-identified patent and that said Letters Patent is hereby corrected as shown below:

| | | |
|---|---|---|
| | line 63: | "{.}" should be --{•}-- |
| Column 5, | line 21; | "$\Omega_p$" should be -- $\Omega_D$-- |
| | line 27: | "$C_L^b$" should be --$C_b^L$-- |
| | line 43: | "axis" should be --axes-- |
| | line 50: | "$a_{Z(1)}$" should be --$a_{z(1)}$--; and, "$a_{(2)}$)" should be --$a_{z(2)}$)-- |
| Column 6, | line 5: | "$C_b^L$" should be --$\dot{C}_L^b$-- |
| | line 15: | "is" should be --are-- |
| | line 16: | "logic" should be --logics-- |
| | line 28: | "$\dot{v}_1^L$" should be --$v_1^L$-- |
| Column 7, | line 4: | "124" should be --134-- |
| | line 37: | insert --to-- after "154" |
| | line 39: | "singals" should be --signals-- |

UNITED STATES PATENT AND TRADEMARK OFFICE

CERTIFICATE OF CORRECTION

PATENT NO. : 4,542,647 Page 3 of 5

DATED : September 24, 1985

INVENTOR(S) : Molnar

It is certified that error appears in the above-identified patent and that said Letters Patent is hereby corrected as shown below:

Column 8, lines 42-44:

$$"Q^L = C_b^L \begin{matrix} q_1 & 0 & 0 \\ 0 & q_2 & 0 \\ 0 & 0 & q_3 \end{matrix} C_L^b"$$

should be $$--Q^L = C_b^L \begin{bmatrix} q_1 & 0 & 0 \\ 0 & q_2 & 0 \\ 0 & 0 & q_3 \end{bmatrix} C_L^b--$$

line 52: "$q_3 = 3.6\ q$" should be --$q_3 = 3.6\sqrt{q}$ -- line 53: " $\mu_3 = -4.5\ q$" should be -- $\mu_3 = -4.5\sqrt{q}$ -- line 61: "casing" should be --casings--

Column 9, line 2: "acceleration" should be --accelerations-- line 9: " $\rho(R)$" should be -- $\rho(\tilde{R})$-- line 38: delete "or wander angle mechanism"; and,

UNITED STATES PATENT AND TRADEMARK OFFICE

CERTIFICATE OF CORRECTION

PATENT NO. : 4,542,647

DATED : September 24, 1985

INVENTOR(S) : Molnar

It is certified that error appears in the above-identified patent and that said Letters Patent is hereby corrected as shown below:

| | |
|---|---|
| | "logic" should be --logics-- |
| line 43: | "$\Omega$" should be --$\hat{\Omega}$-- |
| line 46: | "$C_b^L$" should be --$\dot{\hat{C}}_b^L$-- |
| line 49: | "corect" should be --correct-- |
| line 51: | "$\Omega$" should be --$\hat{\Omega}$-- |
| line 63: | "$\dot{\hat{a}}^B$" should be --$\hat{a}^B$-- |
| line 68 | "$\hat{v}_H^L$" should be --$\dot{\hat{v}}_H^L$-- |
| Column 10, line 12: | "of" should be --to-- |
| line 24: | "$\Omega$" should be --$\hat{\Omega}$-- |
| line 47: | "the" should be --that-- |
| Column 11, line 11: | "logic" should be --logics-- |
| line 65: | "reference" should be --referenced-- |
| Column 12, line 28: | "cooridinate" should be --coordinate-- |
| Column 13, line 23: | insert --,-- (comma) after "first" |
| line 23: | "axis" should be --axes-- |
| line 25: | insert --,-- (comma) after "first"; and, |
| | "axis" should be --axes-- |
| line 32: | "signal" should be --signals-- |
| Column 14, line 8: | "$a_{y(2)}$" should be --$a_{y(1)}$-- |
| line 30: | "column" should be --columns-- |

UNITED STATES PATENT AND TRADEMARK OFFICE

CERTIFICATE OF CORRECTION

PATENT NO. : 4,542,647

DATED : September 24, 1985

INVENTOR(S) : Molnar

It is certified that error appears in the above-identified patent and that said Letters Patent is hereby corrected as shown below:

line 60: insert --,-- (comma) after "first"; and, "axis" should be --axes-- line 62: insert --,-- (comma) after "first"; and, "axis" should be --axes-

Signed and Sealed this

*Nineteenth* Day of *August 1986*

[SEAL]

*Attest:*

DONALD J. QUIGG

*Attesting Officer*

*Commissioner of Patents and Trademarks*